340-566 SR
WIC47 XR 4,112,420

United States Patent [19]
Mifune et al.

[11] 4,112,420
[45] Sep. 5, 1978

[54] APPARATUS FOR DETECTING THE BREAKAGE OF AN ACOUSTICALLY CONDUCTIVE MEDIUM

[75] Inventors: Hideo Mifune; Kenroku Tani; Toyota Noguchi, all of Osaka, Japan

[73] Assignee: Matsushita Electric Industrial Company Limited, Japan

[21] Appl. No.: 703,291

[22] Filed: Jul. 7, 1976

[30] Foreign Application Priority Data

Jul. 31, 1975 [JP] Japan ..... 50-94020
Aug. 18, 1975 [JP] Japan ..... 50-100412
Aug. 20, 1975 [JP] Japan ..... 50-101354

[51] Int. Cl.[2] ..... G08B 13/04
[52] U.S. Cl. ..... 340/550; 340/566
[58] Field of Search ..... 340/274 R, 261, 258 A; 343/5 PD, 7.7

[56] References Cited

U.S. PATENT DOCUMENTS 3,882,494 5/1975 Bolger ..... 340/258 A
3,889,250 6/1975 Solomon ..... 340/261
3,946,377 3/1976 Zetting ..... 340/274 R
4,023,156 5/1977 Galvin ..... 340/274 R

*Primary Examiner*—Glen R. Swann, III
*Attorney, Agent, or Firm*—Lowe, King, Price & Markva

[57] ABSTRACT

A piezoelectric transducer is secured to the surface of a glass sheet to translate mechanical vibrations generated in the glass sheet into an electrical signal when a crack is produced. A detection circuit is connected to the transducer to determine whether the frequency of the signal is above or below a predetermined value. If the frequency is higher than the predetermined value, a warning signal is derived to indicate a crack and therefore probably a burglary. Alternatively, the piezoelectric transducer in the transmit mode is excited electrically by an impulse to introduce an elastic wave into the glass sheet. A gate circuit is connected to the transducer to pass signals resulting from reflection of the elastic wave from discontinuities in the glass sheet which result from a crack. The reflected crack indicating signals are passed through the gate to the transducer when it is in the receive mode.

11 Claims, 26 Drawing Figures

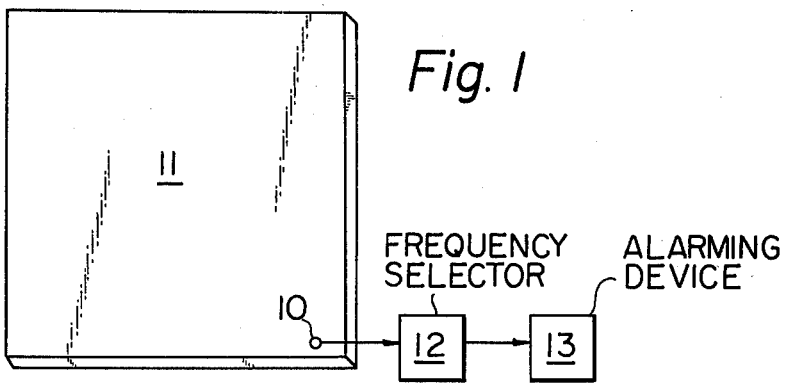
Fig. 1
Fig. 3
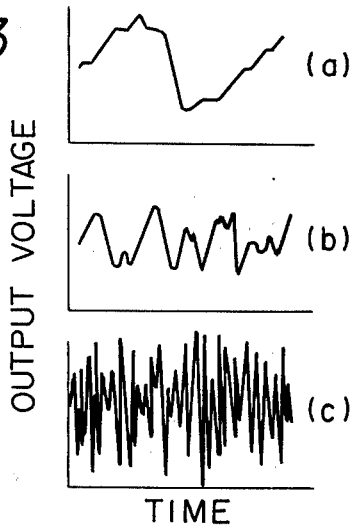
Fig. 2
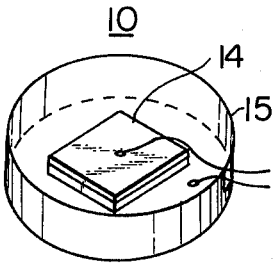
Fig. 4
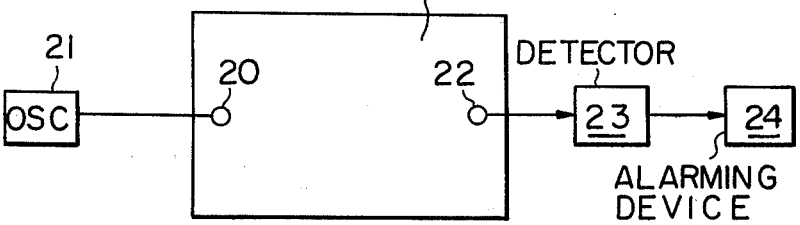

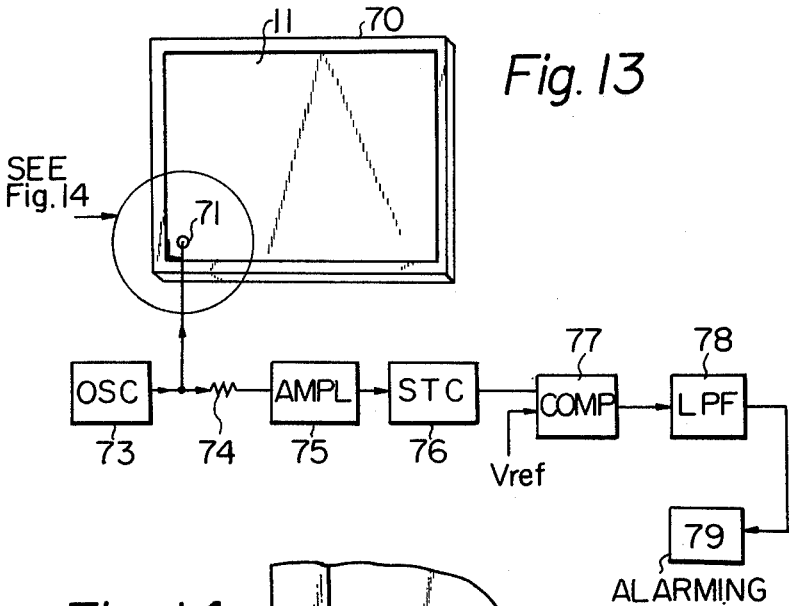
Fig. 13
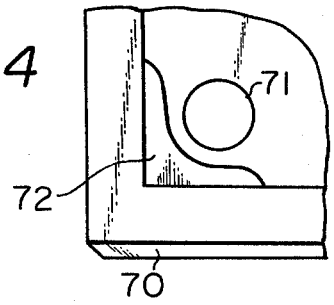
Fig. 14
Fig. 15
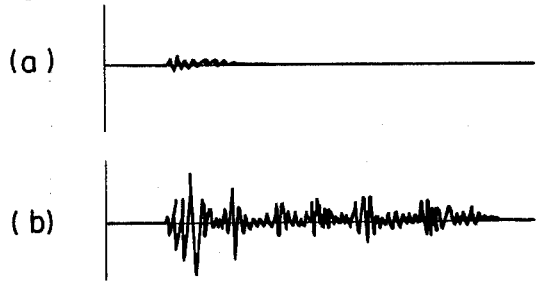

APPARATUS FOR DETECTING THE BREAKAGE OF AN ACOUSTICALLY CONDUCTIVE MEDIUM

FIELD OF THE INVENTION

The present invention relates to apparatus for detecting the breakage of a glass sheet, and in particular to such apparatus wherein a piezoelectric transducer senses mechanical vibrations generated in the glass sheet in response to cracking of the glass sheet.

BACKGROUND OF THE INVENTION

An object of the present invention is to provide apparatus for detecting the breakage of a glass sheet wherein a piezoelectric transducer is secured to the surface of the glass sheet to detect mechanical vibrations or elastic waves which are generated when the glass is broken. The invention has particular application as a burglar alarm.

Another object of the invention is to provide apparatus for detecting the breakage of a glass sheet to which a piezoelectric transducer is secured and electrically excited by an impulse to introduce an elastic wave into the glass sheet, whereby the wave is reflected back to the transducer as it encounters discontinuities in the glass sheet and translated into an electrical signal for utilization as an alarm signal.

BRIEF DESCRIPTION OF THE INVENTION

According to the general aspect of the invention, apparatus for detecting the breakage of a glass sheet comprises a piezoelectric transducer secured to the surface of the glass sheet to translate mechanical vibrations generated in said glass sheet into corresponding electrical oscillations when a crack is produced therein, and a detection circuit connected to the piezoelectric transducer to detect the presence or absence of the electrical oscillations.

According to a first specific aspect of the invention, the apparatus for detecting the breakage of a glass sheet comprises a source of electrical pulses at a predetermined frequency which drives a first piezoelectric transducer that is secured to the surface of the glass sheet adjacent one edge thereof. The first transducer introduces an elastic wave into the glass sheet in response to each pulse. A second piezoelectric transducer, secured to the surface of the glass sheet adjacent the opposite edge, translates the elastic wave into a corresponding electrical signal. A level detector responsive to the second piezoelectric transducer provides an output when the magnitude of the electrical signal falls below a predetermined level.

According to a second specific aspect of the invention, apparatus the for detecting the breakage of a glass sheet comprises a source of electrical pulses at a predetermined frequency that drives a first piezoelectric transducer secured to the surface of the glass sheet adjacent one edge thereof to introduce an elastic wave into the glass sheet. A second piezoelectric transducer, secured to the surface of the glass sheet adjacent to the opposite edge, translates the elastic wave into an electrical signal. A level detector connected to the second piezoelectric transducer provides an output when the magnitude of the electrical signal reduces to zero. Connected to the second piezoelectric transducer is a circuit to select electrical oscillations resulting from mechanical vibrations caused by a cracking of the glass sheet. Connected to the output of said level detector and said selecting means is a circuit to generate a warning signal when either said output is provided or said electrical oscillations are selected.

According to a third specific aspect of the invention, there is provided apparatus for detecting the breakage of a glass sheet wherein a source of electrical pulses at a predetermined frequency drives a piezoelectric transducer secured to the surface of the glass sheet. An elastic wave is introduced into the glass sheet by the transducer when each electrical pulse is introduced, and a circuit connected to the piezoelectric transducer detects electrical oscillations resulting from reflection of the elastic wave from discontinuities in said glass sheet.

BRIEF DESCRIPTION OF THE DRAWING

The invention will be described by way of examples with reference to the accompanying drawings, in which:

FIG. 1 is an illustration of a first embodiment of the invention;

FIG. 2 is a perspective view illustrating a bimorph cell housed in a casing;

FIGS. 3*a*-3*c* are graphic illustrations for comparison, of waveforms caused by a shock produced by the human hand and waveforms caused by a cracking of the glass sheet;

FIG. 4 is an illustration of a second embodiment of the invention;

FIG. 13 is an illustration of a fifth embodiment of the invention in which the glass sheet is clamped by a window frame;

FIG. 14 is a view showing details of a portion of the framed glass sheet of FIG. 13; and FIGS. 15*a* and 15*b* are illustrations of waveforms useful in describing the embodiment of FIG. 13.

DETAILED DESCRIPTION OF THE DRAWING

Figure 5:
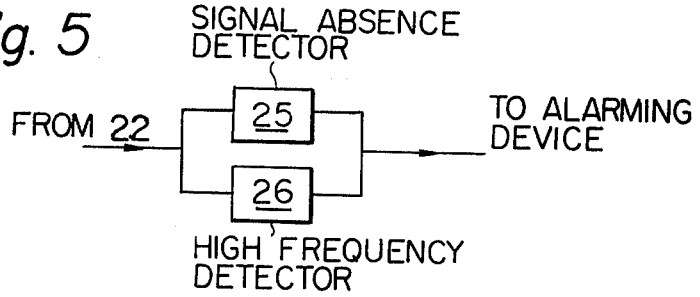
FIG. 5 is an illustration of a modification of the second embodiment.

Referring now to FIG. 1, a first embodiment of the invention is shown schematically as including a piezoelectric detector 10, cemented to the face of a glass sheet 11, to supply an output to a frequency selector 12. The detector 10 comprises, as shown in FIG. 2, a bimorph cell 14 consisting of two piezoelectric plates cemented together in such a way that an applied voltage causes one to expand and the other to contract, so that the cell bends in proportion to the applied mechanical force or electrical signal. The bimorph cell 14 is housed in a metal casing 15 such that one of the piezoelectric plates is in face-to-face contact with the bottom of the casing 15. Cell 14 has first and second output leads respectively connected to the upper face of the cell 14 and the bottom wall of the casing 15; the leads supply a transducer signal to the input of frequency selector 12. In FIGS. 3a-3c are illustrated various waveforms appearing at the output of the bimorph cell 14 when external force is exerted upon the glass sheet 11. The waveforms of FIGS. 3a and 3b are outputs respectively derived from detector 10 in response to sheet 11 being struck by the human hand and a metal rod. When the glass sheet is cracked or broken, a detector 10 derives a waveform as shown in FIG. 3c. From FIGS. 3a-3c, it is seen that when the glass is cracked a higher frequency output signal results than when the glass is merely struck by hand or rod. The frequency selector 12 is designed to select the higher frequency signal that occurs as a result of the cracking or breakage of the glass sheet 11 and passes the selected signal to an alarming device 13.

FIG. 4 is a schematic diagram of a second embodiment of the invention in which a first or input piezoelectric transducer 20 is cemented to the surface of the glass sheet 11 adjacent one edge thereof and connected to a source 21 of electrical pulses to introduce an elastic wave into the glass sheet in response to each pulse. The wave propagates through the glass to the opposite edge where a second or output piezoelectric transducer 22 is provided. Transducer 22 converts the propagated energy into an electrical signal and applies it to a detector 23. When the glass sheet 11 is cracked or broken the mechanical power transmitted from the input source is not entirely propagated and as a result the signal level of the output from the second piezoelectric transducer 22 falls below a predetermined level to activate the alarming device 24.

The detector 23 may comprise, as shown in FIG. 5, a signal absence detector 25 and a high frequency detector 26, both having input terminals connected to the output of piezoelectric cell 22 and output terminals connected to the alarming device 24.

Detector 25 provides an output only in response to its input signals completely disappearing when the glass sheet is broken, while the high frequency detector 26 provides an output when a high frequency signal occurs as a result of a shock producing cracks or breakage of the glass. The alarming device 24 is activated when an output is derived from either of detectors 25 or 26. In practice, it is usually difficult to discriminate between valid signals and false signals since it may sometimes be possible to generate a high frequency signal when the glass is lightly struck with a metal rod. The effect of signal absence detector 25 is to ensure against such ambiguities as to the frequency discrimiation by detecting the complete absence of the signal propagating across the glass, while the detector 26 is designed to detect a valid crack producing signal having a frequency discernible from those ambiguous frequencies.

Figure 6:
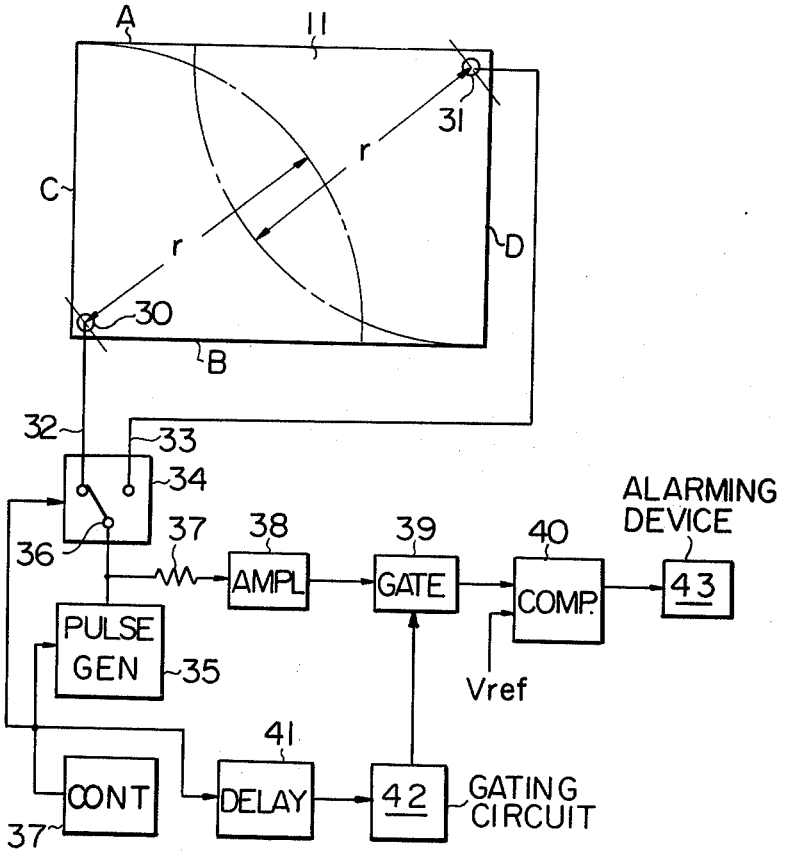
FIG. 6 is an illustration of a third embodiment of the invention.
Figure 7:
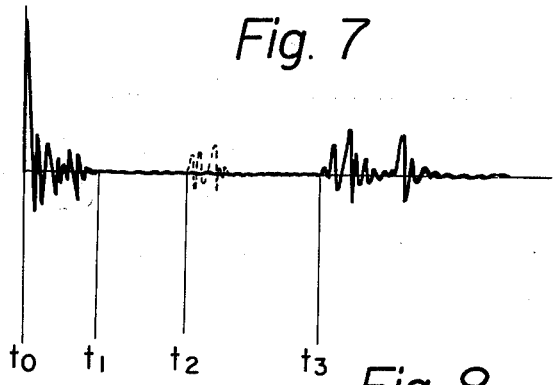
FIG. 7 is a graphic illustration of elastic waves propagating through the glass sheet.

FIG. 6 is an illustration of a third embodiment of the invention in which reflections of propagated waves from the edges of the glass sheet are detected to determine the presence of cracks or breakage. In FIG. 6, first and second piezoelectric cells 30 and 31 are cemented on the surface of the glass sheet 11 at the lower left and upper right corners, respectively; cells 30 and 31 are electrically connected to first and second output terminals 32 and 33 of an electronic switch 34. A pulse generator 35 is coupled to cells 30 and 31 via switch 34 so that an excitation pulse is supplied to sheet 11; the pulse has insufficient amplitude to produce cracks or breakage to sheet 11. The switch 34 is activated by a control pulse provided by a control circuit 37 so switch 34 selectively applies the excitation pulse from generator 35 to one of the detectors 30 and 31. With the pulse generator 35 being connected to cell 30 through contact 32, the pulse applied to cell 30 is translated into a mechanical oscillation which propagates in all directions. The mechanical oscillation is in the form of longitudinal and transverse waves, the former propagating at a speed approximately 1.5 to 2 times higher than the speed of propagation of the latter. Assuming that there is no crack in the glass sheet 11, the transmitted waves reflect from the edges of the glass sheet in two forms: (a) those reflected from the nearby edges B and C or lower-right corner of the sheet 11 occur from the time ($t_o$) the excitation pulse is applied to cell 30 until they are dampened to zero, at time $t_1$ (FIG. 7) and (b) those reflected from the remote edge A of the rectangular glass sheet 11 at a distance equal to the radius $r$ from the center of propagation. These types of reflections are conveniently termed respectively a near-end reflection and a far-end reflection. If no cracks are present in the area within the radius $r$, the far-end reflection propagates back to cell 30 at time $t_3$, but if cracks are present in that area reflections propagate back to cell 30 at time $t_2$ somewhere between times $t_1$ and $t_3$, as shown in broken-line waveform (FIG. 7). The reflections are similar to those experienced in electrical communication wherein the presence of an impedance change in a communication channel results in reflection of a transmitted signal to the sending end of the channel.

Figure 8:
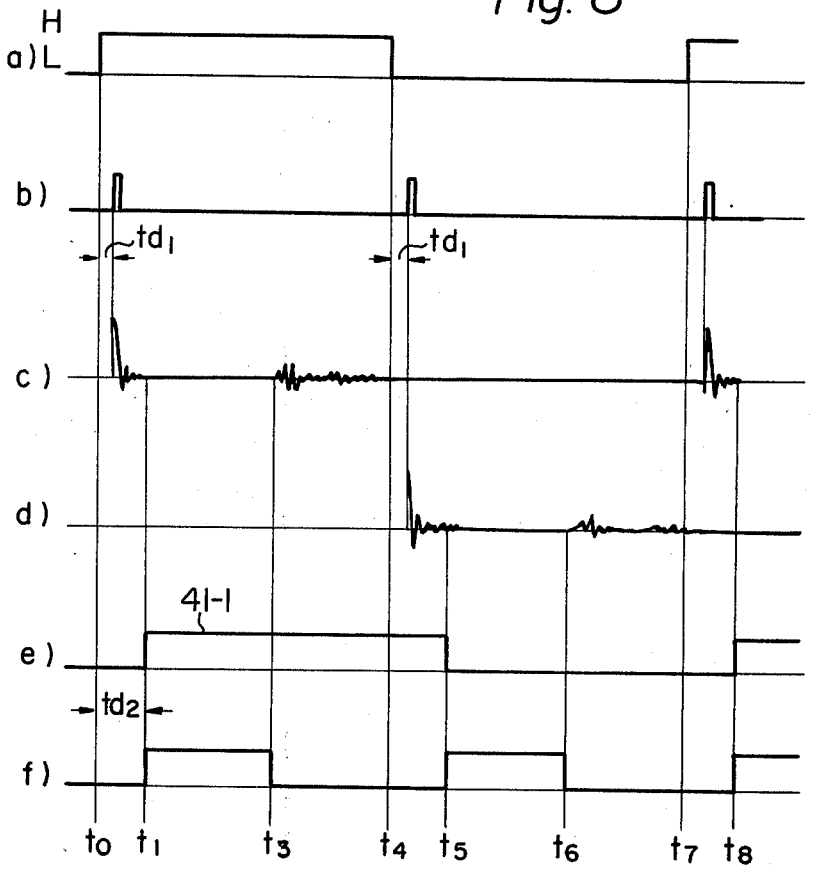
FIGS. 8*a*-8*f* are illustrations of a series of waveforms useful for description of the third embodiment of the invention.

The reflected waves are then converted into electrical signals by the piezoelectric transducer 30 and passed to a transmission gate 39 by a current limiting resistor 37 and an amplifier 38. The operation of the circuit of FIG. 6 is more clearly understood by reference to the waveforms shown in FIGS. 8a-8f. The pulse generator 35 is triggered by circuit 37 to produce an excitation pulse (FIG. 8b). The excitation pulse is derived following a time delay interval of $td_1$ from the leading edge or trailing edge of the trigger signal from the controller 37 (FIG. 8a). When the output of controller 37 is high and low, electronic switch 34 is respectively activated so the pulse from generator 35 is fed to terminals 32 and 33 and thence to cells 30 and 31. The trigger signal from controller 37 is also connected to a delay circuit 41 which delays the applied input signal by $td_2$ (FIG. 8e) so that the leading and trailing edges of the output of circuit 41 respectively occur at times $t_1$ and $t_5$, respectively (FIG. 8e). The delayed signal is fed into a gating circuit 42 which generates a pulse (FIG. 8f) of a predetermined duration in response to the leading and trailing edges of th delayed signal. The duration of the pulse from gating circuit 42 is predetermined by the propagation interval between times $t_1$ and $t_3$ during which no reflections are presumed to occur when no cracks or defects are present within the area defined by radius $r$. The transmission gate 39 is activated by the gating pulse from circuit 42 to pass those signals that are supplied to the gate by amplifier 38 during the interval between times $t_1$ and $t_3$. The output from the gate 39 is applied to a comparator 40 for comparison with a reference voltage Vref to activate an alarming device 43 when the input signal is above the reference voltage.

As indicated supra, cells 30 and 31 are sequentially in circuit with switch 34 so cell 30 is connected to terminal 36 when the output of circuit 37 is high (FIG. 8a) and cell 31 is connected to terminal 36 when the output of circuit 37 is low. During the low condition of the controller output signal, the electronic switch 34 is switched to the output terminal 33 to activate the transducer 31 by the next excitation pulse. Similar reflections occur to those described above, but in this case transducer 31 is searching for cracks or defects within the area defined by radius *r* from the upper-right corner of the glass sheet 11 and near-end reflections occur as a result of reflections from the upper-right corner edges and far-end reflections from the edge B. It is to be noted that reflections from the edges C and D of sheet 11 also also occur within the interval of the pulse from the controller 37. However, such reflections are allowed to be completely attenuated before the next excitation pulse occurs.

Figure 9:
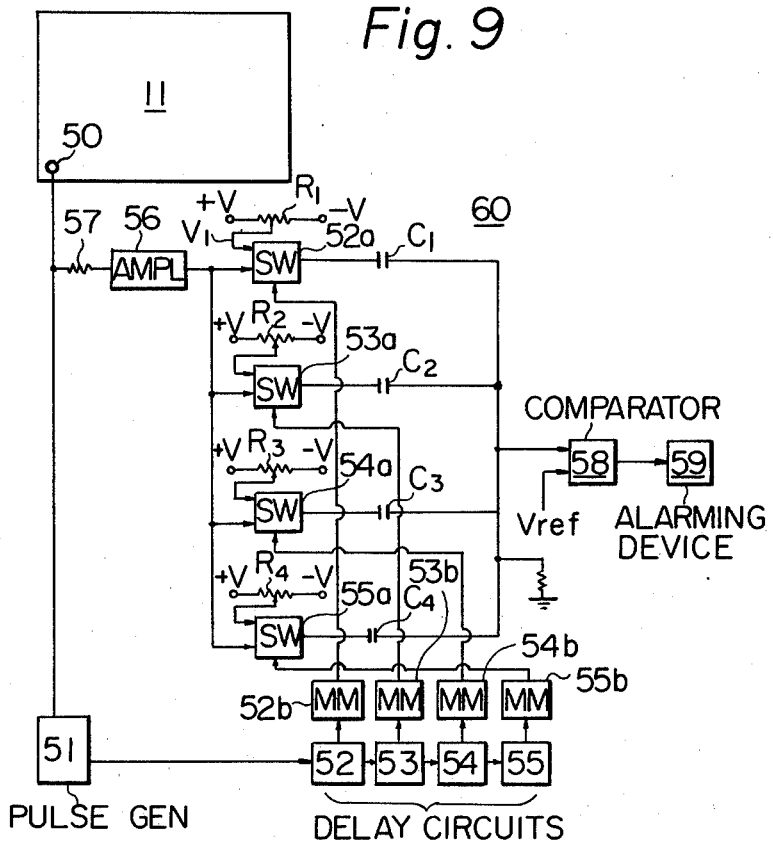
FIG. 9 is a illustration of a fourth embodiment of the invention in which a sampling technique is utilized to discriminate a crack indicating signal from a false signal.

FIGS. 9 to 12 illustrate a fourth embodiment of the invention in which a single piezoelectric transducer and a sampling technique are used to extract signals reflected from cracks. In FIG. 9, a piezoelectric transducer 50, at the lower-left corner of the glass sheet 11, is excited by a pulse from pulse generator 51 also having an output coupled to a series of cascaded delay circuits 52 to 55 of a sampling circuit 60. The sampling circuit 60 includes a plurality of sampling gates or switches 52*a*, 53*a*, 54*a* and 55*a* connected respectively to the delay circuits 52 to 55 through each of monostable multivibrators 52*b*, 53*b*, 54*b* and 55*b*. Each of the sampling switches 52*a* to 55*a* has one input connected to a DC voltage $V_1$ from a respective one of variable resistors $R_1$ to $R_4$ and another input connected in common to the output of an amplifier 56 connected to the piezoelectric transducer 50 through a resistor 57.

Figure 10:
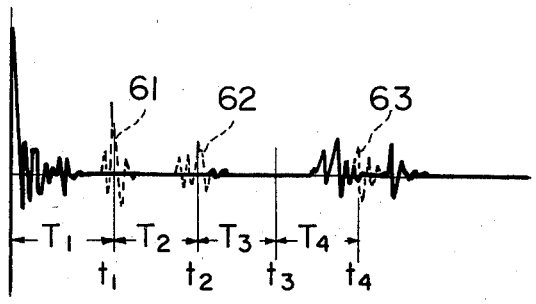
FIGS. 10 and 11*a*-11*d* are illustrations of waveforms useful for describing the circuit of FIG. 9.
Figure 11:
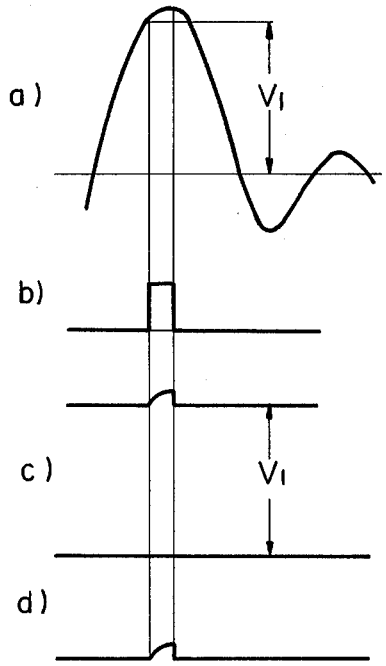

A first delay circuit 52 provides a delay time $T_1$ from the time of application of the excitation pulse to transducer 50 so that a delayed pulse occurs at time $t_1$ as shown in FIG. 10. In such manner delay circuits 53 to 55 provide delay times $T_2$ to $T_4$ so that delayed pulses occur at times $t_2$ to $t_4$. Monostable multivibrators 52*b* to 55*b* generate sampling pulses successively at times $t_1$ to $t_4$, respectively, to activate the sampling switches 52*a* to 55*a* that allow the amplified signals representing the magnitude of reflections to apear at the outputs thereof. While the sampling pulse is not present, each sampling switch is operative to connect the DC voltage $V_1$ to its output terminal. FIGS. 11*a*-11*d* illustrate the operation of sampling switches 52*a* to 55*a*. The sampling pulse (FIG. 11*b*) generated from each of monostable multivibrators 52*b* to 55*b* is used to sample a selected portion of the signal (FIG. 11*a*) from amplifier 56, so that the output waveform of switches 52*a*-55*a*, as shown in FIG. 11*c*, results. Capacitors $C_1$ to $C_4$ are each connected to the output of sampling switches 52*a* to 55*a* to pass the AC component of the signal (FIG. 11*d*) to one input of comparator 58 for comparison with a reference voltage Vref. In FIG. 10, it is assumed that the solid-line waveforms are those obtained from near-end and far-end reflections when no cracks are present, while broken-line waveforms 61 to 63 are those derived from reflections at various cracks or breakages. Under normal crackless conditions, each of the variable resistors $R_1$ to $R_4$ is adjusted to provide an output waveform having an amplitude below the reference voltage Vref of comparator 58. In particular, variable resistor $R_4$ is adjusted to provide a voltage $V_1$ which is substantially equal to the amplitude of the signal resulting from the far-end reflections.

Actually, either of reflections 61 to 63 exceeds the reference voltage Vref to provide an output from comparator 58 to the alarming device 59. Therefore, the sampling circuit 60 permits the use of a single piezoelectric transducer to detect the presence of any cracks in the whole area of the glass sheet 11 by differentiating the crack indicating reflections from the normal reflections.

Figure 12:
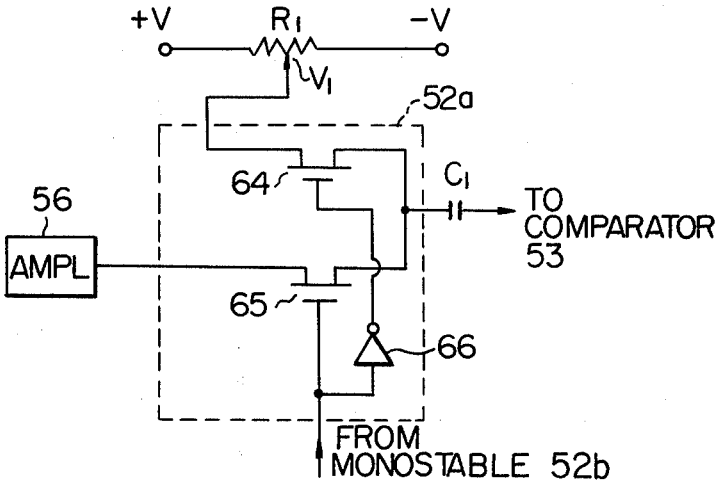
FIG. 12 is a detailed circuit diagram of one of the switching elements used in the circuit of FIG. 9.

FIG. 12 illustrates an example of the sampling switches 52*a* to 55*a*. Each sampling switch is comprised of a pair of field-effect transistors 64 and 65. Transistor 64 has its source-to-drain path connected between the wiper tap of a respective one of variable resistors $R_1$ to $R_4$ and a respective one of capacitors $C_1$ to $C_4$ and its control gate connected to the output of a respective one of monostable multivibrators 52*b* to 55*b* through an invertor 66. Transistor 65 has its source-to-drain path connected between the amplifier output and the filter capacitor and its control gate connected to the monostable multivibrator. Transistor 64 is thus rendered conductive to pass the DC voltage $V_1$ while the output of each monostable multivibrator is at low level, while transistor 65 is rendered conductive when the multivibrator goes high to sample the instantaneous value of the signal from amplifier 56.

FIGS. 13 to 15 illustrate a fifth embodiment of the invention in which the glass sheet 11 is fitted into a frame or sash 70 so that the edges of the glass sheet are clamped. With the edges so clamped, no free vibrations occur at the edges of the sheet 11, and hence no substantial reflections occur from the sheet edges. A piezoelectric transducer 71, connected to an oscillator 73 to be excited to produce mechanical vibrations, is cemented to the face of the glass sheet 11 at the lower-left corner where a shock absorbing member of putty 72 is provided (FIG. 14). Since all the edges of glass sheet are clamped and the substantial portion of the energy that causes near-end reflections is absorbed by the member 72, only small amplitude reflections occur, as illustrated in FIG. 15*a*, under normal crackless conditions. As in the manner previously described, any reflections within the framed window glass sheet 11 are converted into an electrical signal by transducer 71. This signal is then applied to a sensitivity time control amplifier 76 through a limiting resistor 74 and a linear amplifier 75. This sensitivity time control amplifier, known in the field of radar, is programmed to change its amplification gain as a function of time over a predetermined range so that the signals received from short ranges are amplified at a lower gain than those signals at long ranges. Therefore, the output from the STC amplifier 76, a pulsating voltage of a substantially constant amplitude, is applied to an analog comparator 77 for comparison with a reference voltage Vref to provide an output when the input signal is above the reference level. The output from the comparator 77 is passed through a lowpass filter 78 to obtain the DC component of the output from comparator 77. The alarming device 79 is thus operated by the filtered DC voltage representing the magnitude of reflections from cracks (FIG. 15*b*) when present.

What is claimed is:

1. Apparatus for detecting breakage of an acoustically conductive medium, comprising:

means for generating an electrical pulse at predetermined intervals;

a piezoelectric transducer located in said acoustically conductive medium for transmitting said electrical pulse to the medium to introduce discrete elastic wave pulse vibrations in said medium and receiving vibrations from said medium to provide a received electrical signal;

discriminating gate means connected to said transducer for passing signals of which the amplitude is in excess of a predetermined value;

means for activating said gate means at delayed intervals from the instant of generation of said electrical pulse to detect said received electrical signal; and alarm generating means connected to be responsive to pulses passed through said gate means for providing an alarm when the received electrical signal exceeds a predetermined threshold level.

2. Apparatus as claimed in claim 1, wherein said discriminating gate means comprises a plurality of switching elements each having a first input terminal connected to said piezoelectric transducer, a second input terminal connected to a source of DC voltage representative of the magnitude of the vibrations at a predetermined point in time from the application of said electrical pulse and an output terminal normally connected to said second input terminal, means for successively activating said switching elements at points in time corresponding to each of the predetermined points in time to connect the first input terminal to the output terminal of the activated switching element, and a plurality of capacitors each connected between the output terminal of one of said switching elements and an input terminal of said alarm generating means to provide an output representative of the difference between the magnitude of the vibrations resulting from breakage in said medium and the magnitude of the vibrations reflecting from the edges of said medium.

3. Apparatus for detecting breakage of an acoustically conductive medium comprising means for applying discrete elastic wave pulses to the medium, and for detecting the discrete elastic wave pulses, the elastic wave pulses being reflected from edges of an unbroken medium so that the detecting means normally derives an output pulse a predetermined time interval after each discrete elastic wave pulse is applied to the medium, breakage to the medium causing a change in the reflection characteristics of the medium to the elastic wave pulses so that the detecting means derives an output pulse during a time interval different from the normal predetermined time interval, and timing means responsive to the detecting means for effectively determining that the detecting means derives an output pulse during the different time interval to indicate breakage of the medium.

4. The apparatus of claim 3 wherein the means for applying and means for detecting includes an electric wave-elastic wave transducer secured to the medium and the timing means includes means for comparing the occurrence times of reflected pulses picked up by the transducer with predetermined times for the reflected pulses.

5. The apparatus of claim 4 wherein the occurrence time comparing means includes means for comparing the amplitude of the picked up pulses with at least one reference amplitude.

6. The apparatus of claim 5 wherein the amplitude comparing means includes means for comparing the amplitude of the detected pulses during plural different time periods with predetermined different amplitudes established for those periods.

7. The apparatus of claim 6 wherein the comparing means includes a plurality of successively activated amplitude comparing channels responsive to the detected pulses during the different time periods.

8. The apparatus of claim 5 wherein the comparing means includes a gate for passing the detected pulses to the amplitude comparing means during the different time interval, and the comparing means includes means for activating an alarm in response to the amplitude of the pulse passed to it exceeding the reference value.

9. The apparatus of claim 8 wherein a plurality of said transducers are secured to the medium to indicate breakages in differing portions of the medium, means for coupling pulses detected by the different transducers to the same gate, and means for timing the activation of the transducers and enabling the gate to pass the detected up pulses so that reflected breakage indicating pulses from the different portions of the medium are coupled through the gate at mutually exclusive times.

10. The apparatus of claim 3 wherein the timing means includes a variable gain element responsive to the detected wave pulses, means for controlling the gain of said element so that the element has a gain that is directly related to the time since the immediately preceding pulse was applied to the medium.

11. A method for detecting breakage of an acoustically conductive medium comprising applying discrete elastic wave pulses to the medium, detecting the discrete elastic wave pulses, the elastic wave pulses being reflected from edges of an unbroken medium so that there is normally detected an output pulse a predetermined time interval after each discrete elastic wave pulse is applied to the medium, breakage to the medium causing a change in the reflection characteristics of the medium to the elastic wave pulses so that there is detected an output pulse during a time interval different from the normal predetermined time interval, and effectively determining the time when the reflected pulse is detected relative to the time the pulse is applied to the medium, and in response to the determined time being within the different time interval indicating that the medium has been broken.

* * * * *